US005822905A

United States Patent [19]

Teetzel

[11] Patent Number: 5,822,905

[45] **Date of Patent: *Oct. 20, 1998**

[54] FIREARM HAND GRIPS FOR CONTROLLING AN ELECTRONIC MODULE

[76] Inventor: James W. Teetzel, 14 Stratham Green, Stratham, N.H. 03885

[ * ] Notice: The term of this patent shall not extend beyond the expiration date of Pat. No. 5,487,819.

[21] Appl. No.: 764,235

[22] Filed: Dec. 14, 1996

Related U.S. Application Data

[63] Continuation of Ser. No. 303,860, Sep. 9, 1994, Pat. No. 5,584,137, which is a continuation-in-part of Ser. No. 200, 204, Feb. 23, 1994, Pat. No. 5,481,819.

[51] Int. Cl.[6] ..... F41G 1/35; F41G 1/36

[52] U.S. Cl. ..... 42/103; 362/114

[58] Field of Search ..... 42/103, 1.01, 1.02, 42/1.03, 1.04, 1.05, 105; 362/110, 113, 114

[56] References Cited

U.S. PATENT DOCUMENTS

| | | | |
|---|---|---|---|
| 3,914,873 | 10/1975 | Elliott, Jr. et al. | 33/241 |
| 4,541,191 | 9/1985 | Morris et al. | 42/1.01 |
| 4,763,431 | 8/1988 | Allan et al. | 42/66 |
| 5,052,138 | 10/1991 | Crain | 42/1.02 |
| 5,179,124 | 1/1993 | Toole | 42/103 |
| 5,435,091 | 7/1995 | Toole et al. | 42/103 |
| 5,481,819 | 1/1996 | Teetzel | 42/103 |
| 5,584,137 | 12/1996 | Teetzel | 42/103 |

*Primary Examiner*—Stephen M. Johnson

*Attorney, Agent, or Firm*—William B. Ritchie; Michael J. Parsson

[57] ABSTRACT

A hand grip control apparatus for a firearm that controls en electronic module that is mounted on the firearm. The electronic module can be a laser sight, a flashlight, or other modules, either connected to directly to the weapon or closely associated with it. For a 9 mm handgun, the laser module chassis mounts on the front face of the muzzle. For a M-16, the chassis mounts on the weapon handle. The weapons factory installed hand grips are replaced by novel hand grips that contain the electronic controls, water proof activation switches, and power source. The hand grips are wired to the chassis via a flexible internal circuit tape in the case of the 9 mm and waterproof quick disconnect cable for the M-16. The apparatus is designed to be used with commercially available batteries providing about 12 hours of operating time.

20 Claims, 7 Drawing Sheets

FIREARM HAND GRIPS FOR CONTROLLING AN ELECTRONIC MODULE

This application is a continuation of U.S. patent application Ser. No. 08/303,860, filed Sep. 9, 1994, now issued as U.S. Pat. No. 5,584,137, which is a continuation-in-part of U.S. patent application Ser. No. 08/200,204, filed Feb. 23, 1994, now issued as U.S. Pat. No. 5,481,819.

BACKGROUND OF THE INVENTION

1. Field of the Invention

The invention relates to electronic apparatus for use on small firearms, particularly semi-automatic handguns and rifles.

2. Description of the Related Art

It is well known that even a skilled marksman with a handgun have been unable to hit a target as close as 7 meters when attempting to draw the weapon and fire at speed. In target shooting, the shooter must obtain the proper stance by carefully positioning the feet and the "free" hand to find the most stable condition, producing no muscular strain that will adversely effect the accuracy of the shot. Most importantly, the shooter must be able to obtain an identical position each time the weapon is fired to achieve the greatest accuracy. As the whole upper torso moves during each breath, breath control plays a vital role in the process. Since there can be no body movement at the time the trigger is fired, obviously the act of breathing must be stopped during the time the weapon is aimed and fired.

Sight picture and aim are critical if the shooter is to fire the most accurate shot or series of shots. When a mechanical pistol sight is properly aligned, the top of the front sight should be level with the top of the rear sight, with an equal amount of light on either side of the front sight. Using this sight picture requires that the shooter focus his shooting eye so that the sights are in focus and the target is out of focus. Added to the difficulty, all of the above must be maintained while the trigger is released using direct, even pressure to keep the barrel of the gun pointing at the target. These skills require tremendous practice, with each shot fired needing the utmost concentration if the shooter is to obtain maximum accuracy.

It is clear that the recommended methods of achieving maximum shooting accuracy useful for target shooting must be severely modified when a handgun is used in a law enforcement situation. While the degree of accuracy necessary for target shooting and the distances are substantially lower, accuracy is still vital. Law enforcement officers are instructed to fire only as a last resort, cognizant of the fact that their intended target will most likely be killed. Shooting to wound occurs only in the movies. Law enforcement officers typically use higher caliber handguns, mostly 9 mm, which are designed to immobilize with a single shot if that shot strikes a vital area. Given the inherent inaccuracies in the shooting process itself, exacerbated by the stress and fear of the police officer in what may be a life threatening situation for him/her, the exact location of the bullet, where millimeters can mean the difference between death and survival, cannot be known a prior by the even the most skilled marksman.

Mechanical sights have limited value in many situations where an officer must quickly draw his gun, perhaps while moving, and fire at a close target without sufficient time to properly obtain a sight picture. Under these circumstances, instinctive aiming, that is, not using the sights but rather "feeling where the gun barrel is pointing using the positioning of the hand holding the gun", is the preferred method. While this method, akin to the typical television cowboy shoot-outs, can be reasonably effective at short distances, obviously large errors in aiming are easily introduced, especially when the officer must frequently fire his/her weapon from a different hand position that has been used for practice. For example, bullet proof shields are used to protect the officer from being fired upon, such as in a riot situation. In those circumstances, the officer must reach around his/her shield or other barricade and instinctively aim and fire his/her gun with the handgun in a very different orientation that would be experienced if fired from a standing position, drawn from a holster position. Small changes in barrel orientation, due to the sight radius of the typical law enforcement handgun, can produce substantial errors relative to the target. Accurate, instinctive shooting is not considered practical beyond 20 feet for the average shooter.

The same problems face a soldier in a combat situation. While a rifle is inherently more accurate that a handgun, the stress of combat, the need to fire rapidly but accurately in order to survive, is sufficient to introduce substantial errors into the sighting process. These problems are further exacerbated by the fact that most military personnel do not have sufficient practice time with their weapon to develop a high proficiency, particularly in combat simulated situations.

An additional problem encountered in the military situation is the need for a sighting system that can be easily moved from one weapon to another. As warfare increases in sophistication, the need for more versatile armament increases correspondingly. Ideally, an operator should be able to quickly and confidently move the sighting system from one weapon to another without needing any field adjustments.

A solution to this problem for handguns has been the introduction of laser sights. The typical laser sight is mounted on the top on the handgun or on the bottom. The laser sight, when properly aligned, places a red light dot on the target where the bullet will strike if the gun is fired. Using this type of sight, enables the law officer to rapidly, instinctively, properly position the weapon and be certain of his/her intended target. Using a laser sight enables accurate shots to be fired at distances of more than 50 feet, sufficient for most combat law enforcement situations requiring the use of handguns.

U.S. Pat. No. 4,934,086, issued to Houde-Walter on Jun. 19, 1990, discloses installing the laser sight within the recoil spring guide. The use of the recoil spring guide to house the laser sight components enables the firearm to be holstered in a normal manner. The use of the spring recoil guide presents alignment problems to ensure accuracy. In other words, the laser within the recoil guide is difficult to align with the barrel of the firearm. Therefore, misalignment of the sight resulting in poor accuracy is likely.

A laser sight for a standard military issue weapon such as the M-16 that can be attached to the weapon without requiring a major modification of the firearm is not available. Use of the type of laser sights discussed below for handguns will also exhibit the same type of problems relative to installation on an M-16.

Prior art laser devices have several disadvantages. As they are mounted either on the top or the bottom of the weapon, the balance of the gun is disturbed which makes it more difficult for the shooter to rapidly use his/her instinctive sighting technique to move the gun into alignment for hitting the desired target. The particular design of the M-16, having a carrying handle on the top of the firearm, makes adding a prior art laser device to this weapon impractical. Also, since prior art laser sights are very bulky in comparison to traditional mechanical sights, when used with a handgun, the weapon cannot be used in a standard holster. Further, the laser sight is extremely vulnerable to being hit due to extending substantially beyond the normal profile of the weapon, thereby causing misalignment of the sight and defeating the advantages offered by the laser sight. A laser sight or other electronic module capable of being installed in a semi-automatic handgun or on a military rifle such as an M-16, easily and accurately adjustable, and moveable from one weapon to another without the need for field adjustments and that can be activated using one or more buttons positioned within modified handgrips on the weapon, with the modified handgrips having one or more flexible circuits is not disclosed in the prior art.

SUMMARY OF THE INVENTION

It is an aspect of the invention to provide a hand grip control apparatus for controlling an electronic module for a firearm that fits within the profile of the weapon that the module is to be installed upon.

It is still another object of the invention to provide a hand grip control apparatus for controlling an electronic module for a firearm that can be controlled from one or both of modified handgrips that attached to the firearm.

It is another aspect of the invention to provide a hand grip control apparatus for controlling an electronic module for a firearm that can be retrofitted to standard semi-automatic handguns or to standard military rifles such as an M-16.

It is still another aspect of the invention to provide a hand grip control apparatus for controlling an electronic module for a firearm that can be easily moved from one weapon to another without the need for to align the laser located in the module.

It is still another aspect of the invention to provide a hand grip control apparatus for controlling an electronic module for a firearm that can be fitted to various semi-automatic handguns and military rifles requiring a minimum replacement of standard parts.

It is another aspect of the invention to provide a hand grip control apparatus for controlling an electronic module for a firearm that can be easily adjusted by the user to permit the accurate alignment of the laser sight with the barrel of the gun.

It is another aspect of the invention to provide a hand grip control apparatus for controlling an electronic module for a firearm that can be inexpensively produced using primarily commercially available parts.

It is another aspect of the invention to provide a hand grip control apparatus for controlling an electronic module for a firearm that can incorporate an infrared diode that makes the dot invisible to the naked eye, but clearly visible using standard night vision equipment.

It is still another aspect of the invention to provide an electronic module apparatus that includes a removable flashlight module, incorporating both infrared and visible light.

It is another aspect of the invention to provide a hand grip control apparatus for controlling an electronic module for a firearm that is extremely light compared to existing lasers and their mounts.

It is still another aspect of the invention to provide a hand grip control apparatus for controlling an electronic module for a firearm that can be controlled using an easily operated keypad attached to one or more modified handgrips which replace the standard factory handgrips with the modified handgrip having a flexible circuit designed to fit therein.

It is another aspect of the invention to provide a hand grip control apparatus for controlling an electronic module for a firearm that can be powered by commercially available batteries, providing at least several hours of service time before needing to be changed.

It is another aspect of the invention to provide a hand grip control apparatus for controlling an electronic module for a firearm that will incorporate a delay when the frame mounted switch is deactivated before the laser is turned off, thus permitting time for the user to activate the trigger switch without losing sight on the target.

It is another aspect of the invention to provide a hand grip control apparatus for controlling an electronic module for a firearm that will provide an adjustable pulse rate so that "friendly" laser beams can be distinguished from a laser beam from an enemy.

It is another aspect of the invention to provide a hand grip control apparatus for controlling an electronic module for a firearm that eliminates the need for a pressure pad on the grip handle which is awkward when holding the gun and requires adjustments to the shooter's grip to keep the laser off while maintaining stability.

The invention is a hand grip control apparatus for controlling an electronic module for a firearm having left and right hand grips attachment members. The left and right hand grips are dimensioned and sized to be attached respectively to said left and right hand grips attachment members of said firearm. At least one said left and right hand grips is provided with at least one switch mounted on the exterior surface of said grip, wherein said electronic module is controlled by said switch. A connection for electronically connecting said switch to said electronic module is provided. A flexible circuit in at least one of said hand grips is provided. The flexible circuit is positioned adjacent to and corresponding in size to the interior surfaces of said hand grip, said switch being connected to said flexible circuit, whereby activating the switch, activates the electronic module of the firearm.

DETAILED DESCRIPTION OF THE INVENTION

Figure 1:
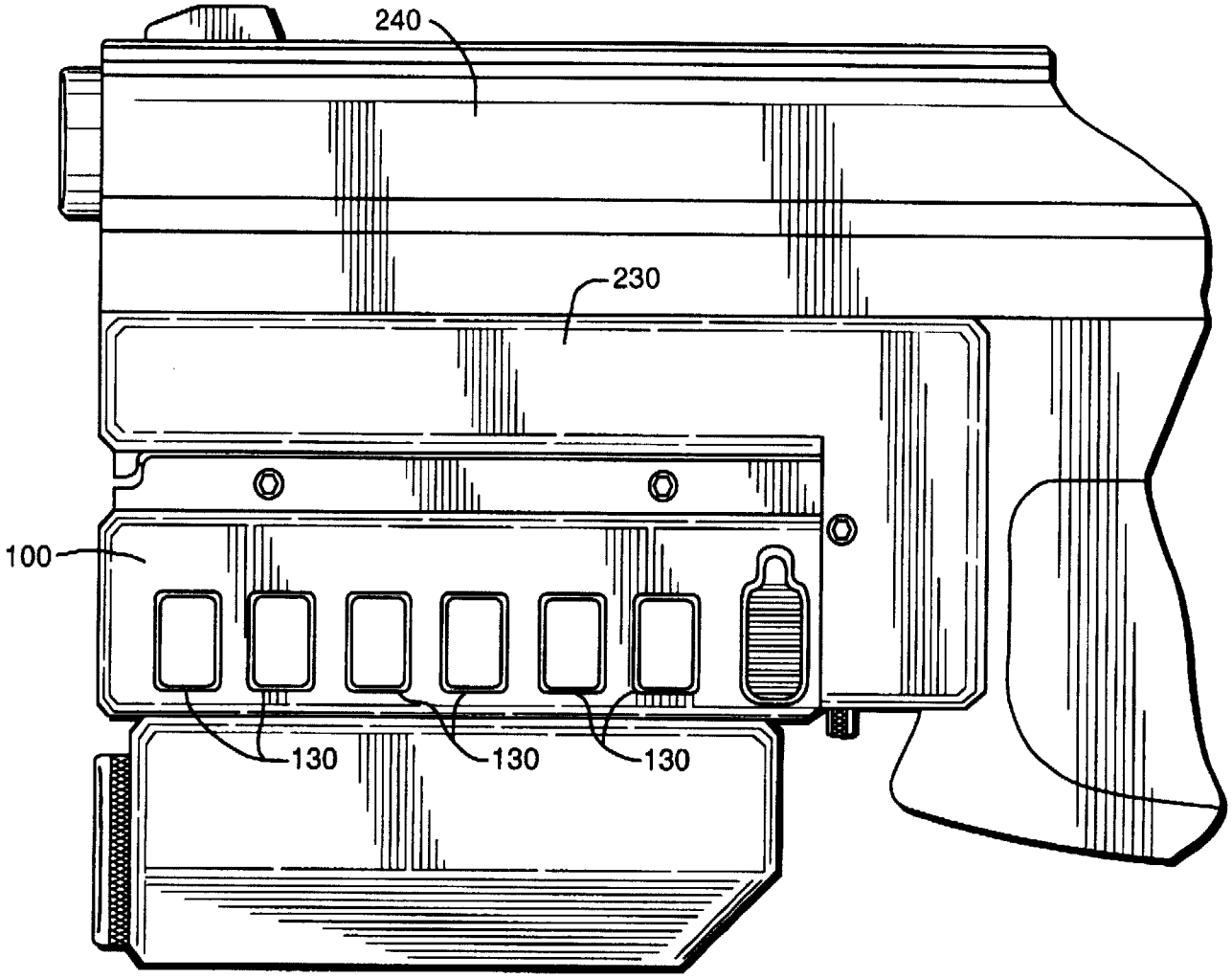
FIG. 1 is a side view of an electronic modular apparatus mounted on a typical handgun.

The invention is a hand grip control apparatus for controlling an electronic module apparatus for a firearm, such as the offensive handgun, as well as M4A1, M16, SMAW-D and other small arms such as shown. As shown in FIG. 1, module 100 attaches to weapon 240 via interface chassis 230 which allows the operator to quickly move module 100 from one weapon platform to another. In this example, module 100 is a laser apparatus, however, other selections are possible, either attached directly to the weapon or to be used within close proximity of the weapon. The laser module 101 is releasably attachable to the chassis and has a front face with at least one laser device housed within which emits a laser beam from the front face of the laser module 101. A flashlight module may also be releasably attached to the laser module 101. In this embodiment, the flashlight has at least one light source which emits a beam of light from the front of the flashlight module. Waterproof buttons 130, control the operation of the laser and flashlight modules and are adapted to allow the laser module to switch between infrared laser, visible laser, infrared flashlight and laser flashlight modes as well as controlling the pulse rate of the laser options.

Figure 2:
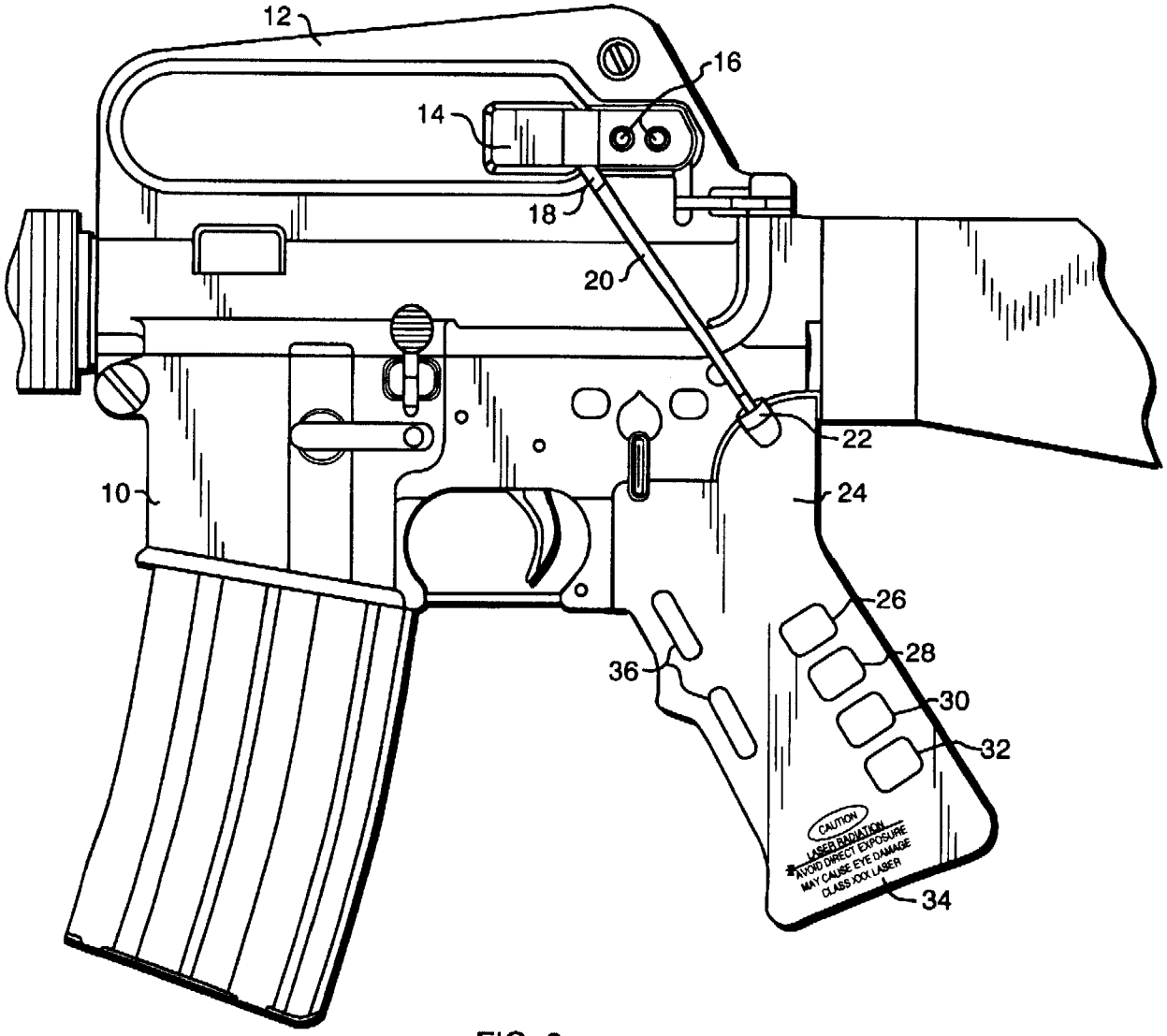
FIG. 2 is a side view of an M16 showing an electronic modular apparatus being controlled by hand grips in accordance with the invention mounted on the handle of the M16.

FIG. 2 is a partial side view of M16 10 with laser module apparatus attached. Three major components are shown: hand grip assembly which houses the circuitry, batteries and controls for the apparatus; the electronic module, e.g., the laser chassis; and the connection harness which electrically connects the chassis with the hand grips. Hand grips 24 replace the standard hand grips that are issued with weapon 10. Hand grips 24 correspond closely in size and shape to the original equipment grips. As shown, the apparatus can be easily controlled by the operator by pushing the rubber switch buttons on grip 24. Rubber switch button are waterproof so that the circuitry is protected during use in adverse weather conditions. Button 26 selects the infrared laser. Button 28 selects the laser pulse rate. The pulse rate is adjustable so that the operator can set their weapons to a different pulse rate than that of an enemy. In this manner, it is an easy matter to determine friend from foe. Button 30 selects a visible red laser. Button 32 turns the system on or off. Button 36 activates the chosen laser, that is, either visible or infrared when pressed. Indicia 34 instructs the operator as to proper procedure to follow to avoid eye injury. Chassis 14, which houses the laser diode assembly is attached to handle 12 of weapon 14 within the recess of the handle. Thus, the apparatus can be connected to weapon 10 without the need for modifying weapon 10, yet, fit within the existing profile of the firearm so that it will not interfere with carrying, storing or firing the weapon.

Chassis 14 is held onto handle 12 by merely tightening set screws 16.

Cable 20 electrically connects chassis 14 to hand grips 24. Cable 20 is preferably waterproof. Cable 20 connects to chassis 14 through rubber boot 18. Cable 20 connects to hand grips 24 via a male waterproof quick disconnect 22.

Figure 3:
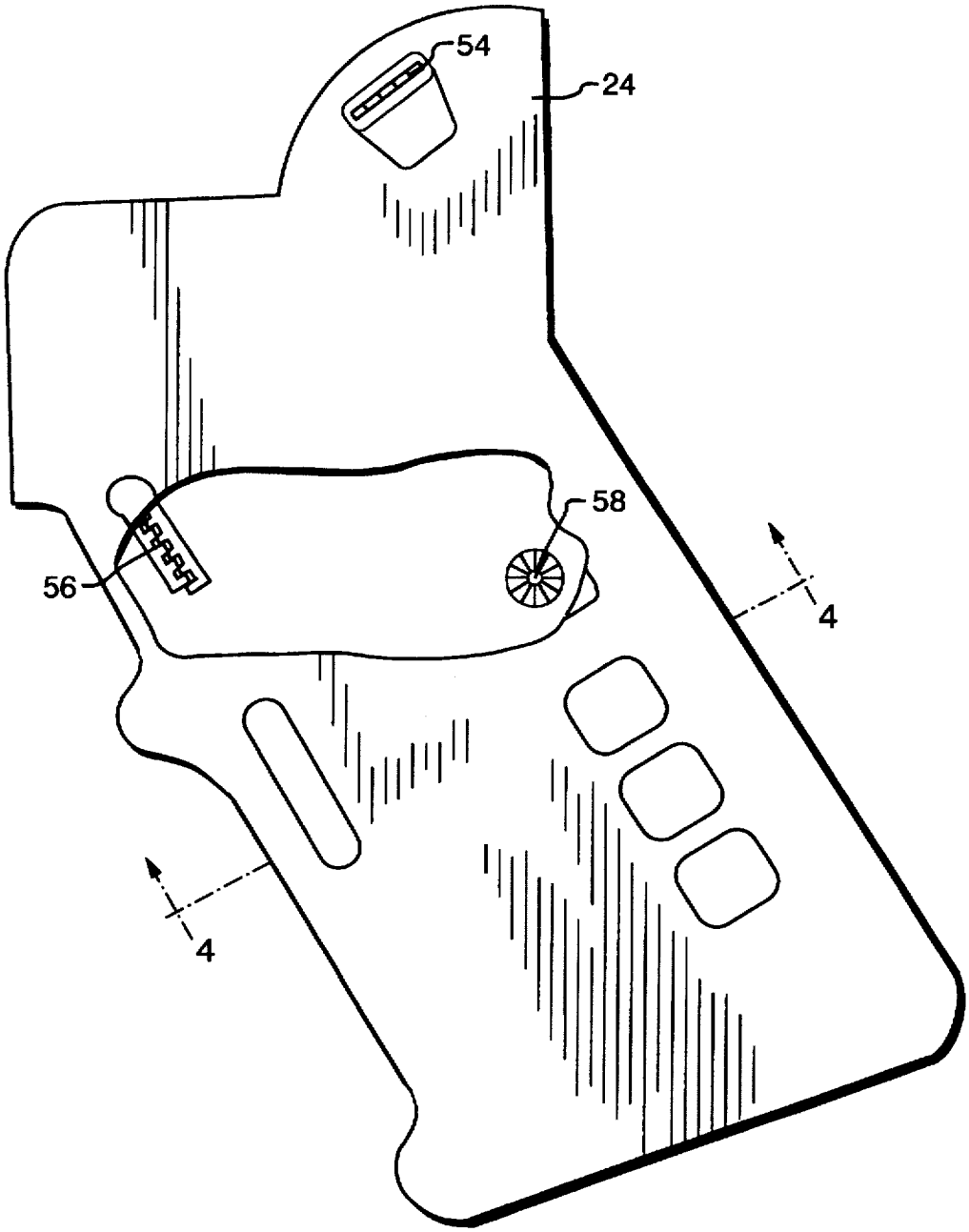
FIG. 3 is a side view of the modified left hand grip assembly.

FIG. 3 is a side view of modified left hand grip 24 showing a cut-a-way view of the button contact 56 and 58 on the flexible circuit 50. Female quick disconnect 54 connects to cable 20 (shown in FIG. 2).

Figure 4:
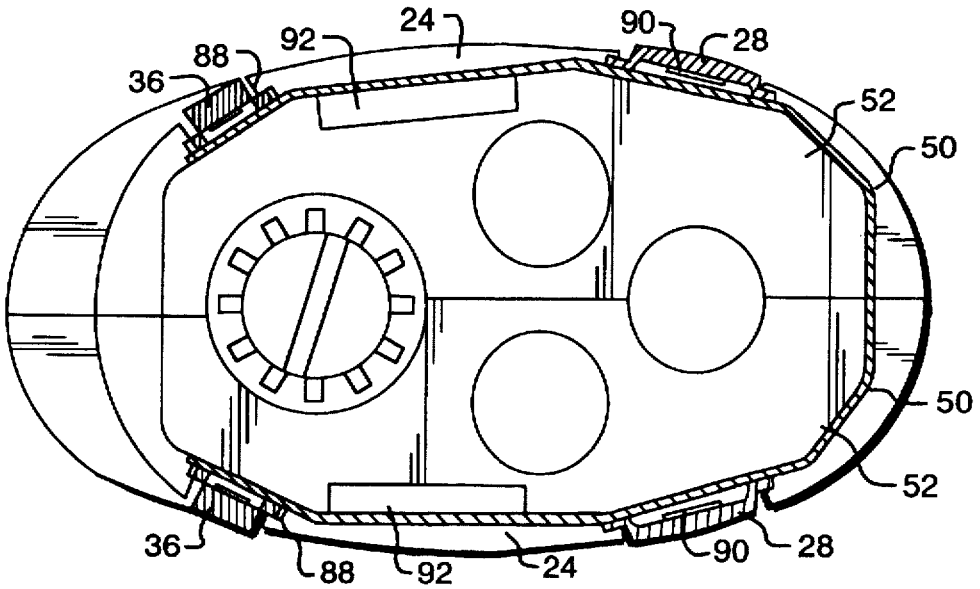
FIG. 4 is a cross-sectional view of the handgrips attached to a typical rifle across 4—4 of FIG. 3.

FIG. 4 is a cross-sectional view of the handgrips attached to the M-16 across 4—4 of FIG. 3. Flexible circuit 50 is shown fitted within the interior wall of left hand grip 24. The flexible circuit 50 is shown fitted with interior wall of right hand grip 24. Rubber button 28, for example, when pushed causes conductive rubber puck 90 to make an electrical connection with a contact (such as 56 and 58, shown in FIGS. 3 and 5) thus to select the corresponding function in the apparatus. Recesses 92 house electronic components that are soldered to the flexible circuits. Stiffeners 52 hold the flexible circuits in place within the hand grips 24, respectively.

Figure 5:
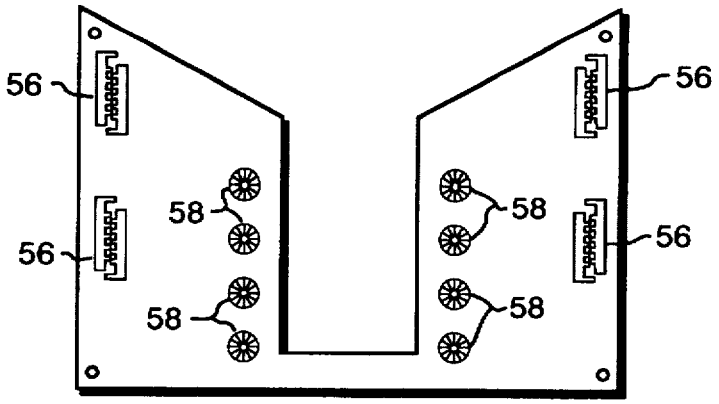
FIG. 5 is a top view of the flexible circuit that fits within the modified hand grips assembly.

FIG. 5 is a top view of the flexible circuit that fits within the modified hand grips assembly. Contacts 58 are the buttons on the left side hand grips 24 and contacts 58 are for the buttons on the right side hand grips 24. Flex circuit is sized in accordance with grips 24. When fitted to other sized firearms, the size of the flexible circuits are adjusted accordingly. However, the functional circuitry would remain the same.

Figure 6A:
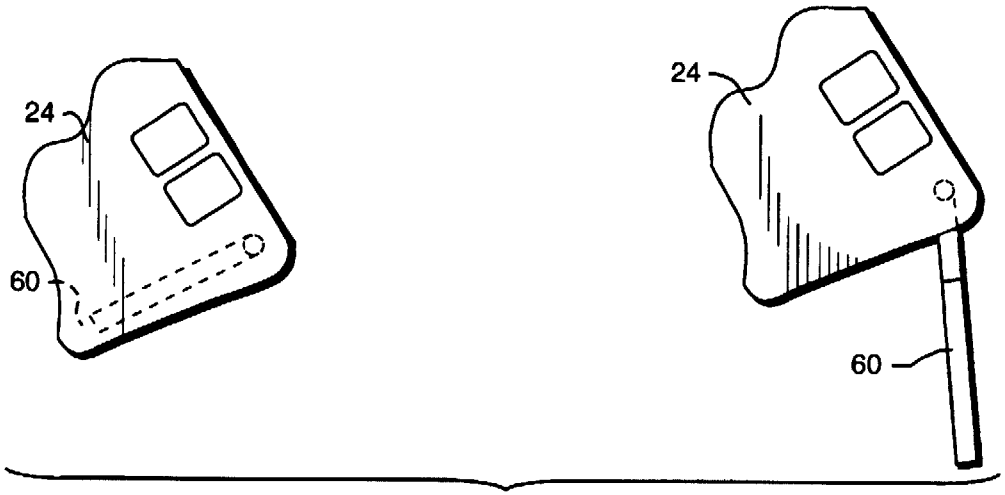
FIG. 6A is a partial side of the left modified hand grip showing the battery door in a closed and opened position.
Figure 6B:
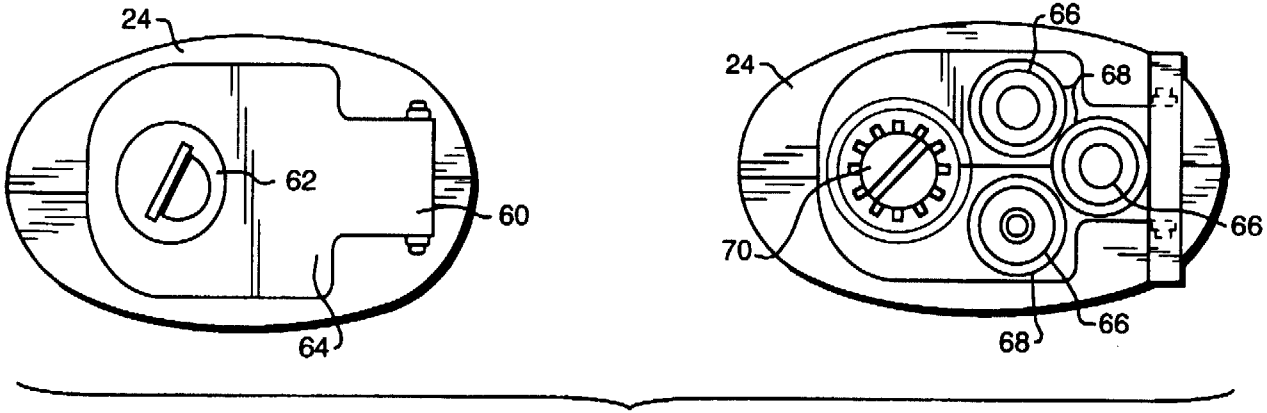
FIG. 6B is a bottom view of the modified hand grips in place on the M16 showing the battery door in a closed and opened position.

FIG. 6A is a partial side of the left modified hand grip 24 showing the battery door 60 in a closed and opened position. FIG. 6B is a bottom view of the modified hand grip 24 in place on the M16 10 showing the battery door 60 in a closed and opened position. Battery door 60 is opened by inserting a bullet casing into locking screw 62. Once opened, screw and washer assembly 70 is shown. Assembly 70 is used to mount the hand grips to weapon 10. Three commercial batteries 66, AAA size, are used to power the unit. O-ring seals 68 seal the batteries against moisture that might leak through door 60 that could damage the unit.

Figure 7:
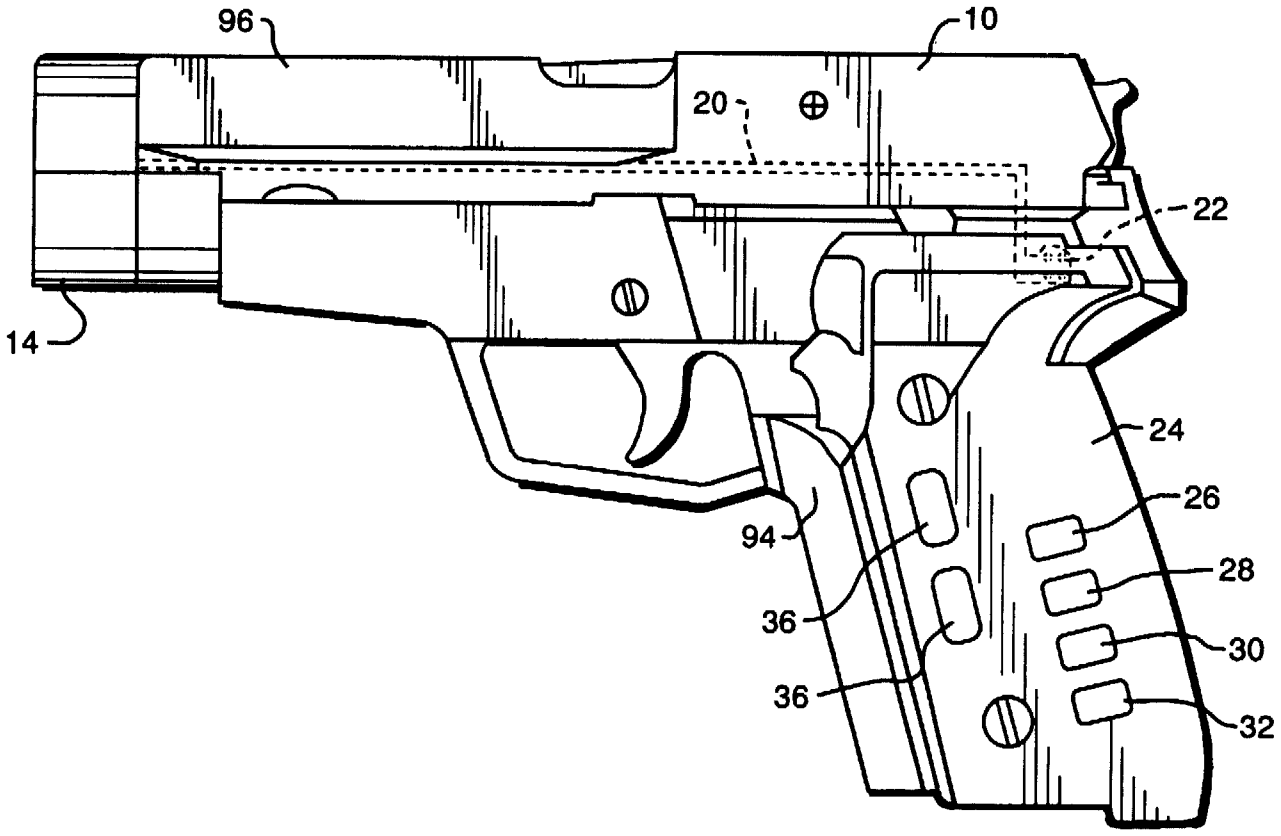
FIG. 7 is side view of a laser module apparatus attached to a typical semi-automatic handgun controlled by the hand grips in accordance with the invention.

FIG. 7 is side view of the laser module apparatus attached to a typical semi-automatic handgun 10. In this case, weapon 10 is SIG-SAUER Model P228, 9 mm, with a 13 cartridge clip or magazine. This particular pistol has been adopted by numerous military and law enforcement agencies as the weapon of choice because of its large magazine capacity, reliability, and accuracy. In operation, the slide 96, guided by a recoil spring guide and tensioned by recoil a spring, is slid backwards along frame, tensioning the recoil spring. The barrel and the recoil spring guide extend through barrel hole and recoil spring guide hole respectively. Therefore, once slide 96 is released, the spring causes slide 96 to move forward, strip a round from the magazine, and place the cartridge into the firing chamber. When slide 96 is in its most forward position on frame, the recoil spring guide and the barrel are substantially flush with front face of slide 96.

In this embodiment, chassis 14 is mounted on the muzzle of the weapon 10. Chassis 14 is the same here with the respect the laser module previously discussed, only the external shape of chassis 14 is changed to match that of the weapon that chassis 14 is installed on. Again, chassis 14 can be attached with minimum changes to the weapon as it comes from the factory. Hand grips 24 are modified to replace the original equipment hand grips (not shown) that are shipped with weapon 10. Again, as with the M-16, hand grips 24 are sized in accordance with the factory original grips. Therefore, frame section 94 of the weapon 10 is not covered as is the case using the factory grips.

The invention is powered by commercially available batteries, with 2 "AAA" batteries located in the weapon grips. In addition, the electronic module that is selected could also have its own power supply in addition to the battery power provided within the weapon grips. Battery life of the system may be tested by depressing a sequence of buttons. If good, the red laser will emit a constant beam. A blinking beam indicates batteries are low and should be replaced.

Figure 8:
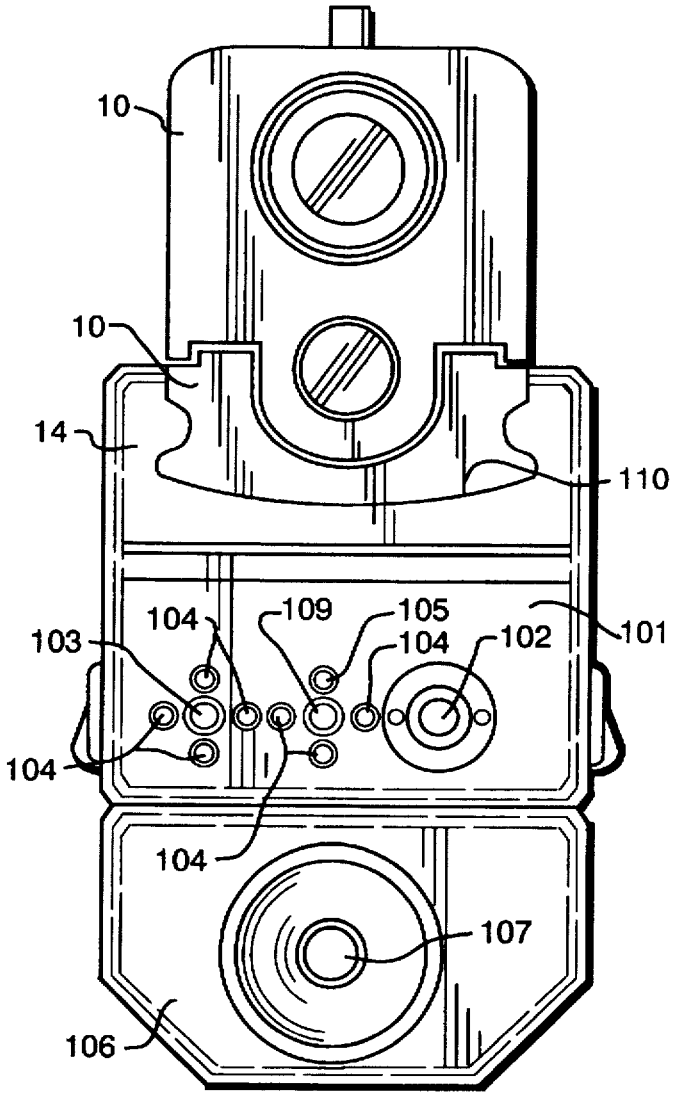
FIG. 8 is a front view of a modular laser apparatus mounted on the semiautomatic handgun of FIG. 7.

FIG. 8 is a front view of modular laser apparatus mounted on the semiautomatic handgun of FIG. 7. Chassis 14 is shown attached to weapon 10. Note that surface contour 110 of chassis 14 is dimensioned to fit the profile of the weapon 10. When chassis 14 is mounted on a different weapon, surface contour 110 or other aspects of the geometry of chassis 14 may change, however, the adjustment features described herein will be same of every version. In this manner, laser module 101 and its attached flashlight module 106 can be moved from weapon to weapon without requiring additional adjustments to sight in the weapon. As shown, infrared flashlight 102 is located on laser module 101 and visible flashlight 107 is a part of flashlight module 106. Infrared laser assembly 105 and visible laser assembly 103 are housed within laser module 101. While these are preferred positions, other variations and permutations are possible. For example, the infrared flashlight 102 could be located within flashlight module 106.

Laser assemblies 103 and 105 are adjusted using adjustments screws 104 and 109, respectively. Preferably, these screws adjust the lasers as previously disclosed by the inventor in prior applications. The preferred parts list and necessary electrical connections have also been previously described in great detail in the prior application.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A hand grip control apparatus for a firearm having left and right hand grips attachment members, said hand grip control apparatus comprising:

an electronic module having a plurality of modes of operation that is dimensioned to be attached to said firearm;

left and right hand grips having interior and exterior surfaces, dimensioned and sized to be attached respectively to said left and right hand grips attachment members of said firearm;

at least of one said left and right hand grips having a plurality of switches mounted on the exterior surface of said grip, wherein said plurality of modes of operation of said electronic module are controlled by said plurality of switches; and a connection for electronically connecting said plurality of switches to said electronic module, said connection comprising a flexible circuit in at least one of said hand grips, said flexible circuit being adjacent to, and corresponding in size to, the interior surfaces of said hand grip.

2. The hand grip control apparatus of claim 1 further comprising a power source dimensioned to fit within said hand grip.

3. The hand grip control apparatus of claim 1 wherein said connection between said plurality of switches and said electronic module is a cable internal to said firearm.

4. The electronic apparatus of claim 1 wherein said electronic module comprises:

a chassis mountable on said firearm;

a laser module, releasably attachable to said chassis, said laser module having a front face with at least one laser device able to emit a laser beam, said device being housed within said laser module, with the laser beam from said laser device exiting the front face of said laser module.

5. The hand grip control apparatus of claim 4 wherein said electronic module further comprises:

a flashlight module, releasably attachable to said laser module, said flashlight module having a front face with at least one light source able to emit a light beam, said light source housed within said flashlight module, with the light beam from said light source exiting the front face of said flashlight module.

6. The hand grip control apparatus of claim 4 wherein said chassis further comprises an adjustment mechanism for aligning said chassis with said firearm, wherein said laser module will then accurately sight on an intended target of said firearm.

7. The hand grip control apparatus of claim 1 wherein at least one of said plurality of switches controls a flashlight module.

8. The hand grip control apparatus of claim 1 wherein said plurality of switches control modes of operation chosen from a group consisting of infrared laser, visible laser, infrared flashlight and visible flashlight.

9. The hand grip control apparatus of claim 1 wherein one of said plurality of switches controls a pulse rate of a laser.

10. The hand grip control apparatus of claim 1 wherein said plurality of switches are controlled by a plurality of waterproof switch buttons.

11. A hand grip control apparatus for a firearm having left and right hand grips attachment members, said hand grip control apparatus comprising:

an electronic module having a plurality of modes of operation that is dimensioned to be attached to said firearm, said electronic module comprising a chassis mountable on said firearm, and a laser module, releasably attachable to said chassis, said laser module having a front face with at least one laser device able to emit a laser beam, said device being housed within said laser module, with the laser beam from said laser device exiting the front face of said laser module;

left and right hand grips having interior and exterior surfaces, dimensioned and sized to be attached respectively to said left and right hand grips attachment members of said firearm;

at least of one said left and right hand grips having a plurality of switches mounted on the exterior surface of said grip, wherein said plurality of modes of operation of said electronic module are controlled by said plurality of switches; and a connection for electronically connecting said plurality of switches to said electronic module.

12. The electronic apparatus of claim 11 further comprising a power source dimensioned to fit within said hand grip.

13. The hand grip control apparatus of claim 11 wherein said connection between said plurality of switches and said electronic module is a cable internal to said firearm.

14. The electronic apparatus of claim 11 wherein said electronic module further comprises:

a flashlight module, releasably attachable to said laser module, said flashlight module having a front face with at least one light source able to emit a light beam, said light source housed within said flashlight module, with the light beam from said light source exiting the front face of said flashlight module.

15. The electronic apparatus of claim 14 wherein said laser module further comprises a keypad having a plurality of buttons for controlling said laser module.

16. The electronic apparatus of claim 15 wherein at least one of said buttons controls said flashlight module.

17. The electronic apparatus of claim 11 wherein said chassis further comprises an adjustment mechanism for aligning said chassis with said firearm, wherein said laser module will then accurately sight on an intended target of said firearm.

18. The hand grip control apparatus of claim 11 wherein said plurality of switches control modes of operation chosen from a group consisting of infrared laser, visible laser, infrared flashlight and visible flashlight.

19. The hand grip control apparatus of claim 11 wherein one of said plurality of switches controls a pulse rate of a laser.

20. The hand grip control apparatus of claim 11 wherein said plurality of switches are controlled by a plurality of waterproof switch buttons.

* * * * *